US005314305A

United States Patent [19]

Fink

[11] Patent Number: 5,314,305

[45] Date of Patent: May 24, 1994

[54] COMPRESSED AIR VIBRATOR WITH TURBINE DRIVE

[75] Inventor: Willy Fink, Schaffhausen, Switzerland

[73] Assignee: Findeva AG, Oerlingen, Switzerland

[21] Appl. No.: 30,613

[22] Filed: Mar. 12, 1993

[30] Foreign Application Priority Data

Mar. 17, 1992 [CH] Switzerland ..... 848/92

[51] Int. Cl.[5] ..... B06B 1/16; B06B 1/18

[52] U.S. Cl. ..... 415/202; 415/214.1; 366/124

[58] Field of Search ..... 415/202, 214.1; 366/124

[56] References Cited

U.S. PATENT DOCUMENTS

| | | | |
|---|---|---|---|
| 2,793,009 | 5/1957 | Peterson | 415/202 |
| 2,875,988 | 3/1959 | Wysong | 415/202 |
| 2,917,290 | 12/1959 | Peterson | 415/202 |
| 3,003,733 | 10/1961 | Peterson | 415/213.1 |
| 3,074,151 | 1/1963 | Kroeckel | 415/202 |
| 3,237,505 | 3/1966 | Peterson | 415/213.1 |
| 3,355,957 | 12/1967 | Peterson | 415/213.1 X |
| 3,822,054 | 7/1974 | Matson | 366/124 X |
| 3,870,282 | 3/1975 | Wadensten | 415/202 |
| 3,932,057 | 1/1976 | Wadensten | 415/202 |
| 3,938,905 | 2/1976 | Wadensten | 415/202 |
| 4,435,083 | 3/1984 | Matson | 366/124 X |
| 4,604,029 | 8/1986 | Fink | 415/202 X |

*Primary Examiner*—Edward K. Look
*Assistant Examiner*—Michael S. Lee
*Attorney, Agent, or Firm*—Cushman, Darby & Cushman

[57] ABSTRACT

The compressed air vibrator has a housing (1) with an inlet opening (8) for admitting compressed air to a chamber (14) and an outlet opening (9) for the exit of air from the chamber (14). Ball bearing assemblies (11, 15) are disposed with slight play on the shafts (2*a*, 2*b*) of the rotor (2). These ball bearings are fitted, also with slight play, in bores (12*a*, 13*a*) of oppositely located covers (12, 13) that close about the rotor (2) and close the open ends of chamber (14). The play is adjusted in such a way that the outer races (11*a*, 15*a*) of the ball bearings turn in the bores (12*a*, 13*a*) of the covers during the rotational movement of the rotor (2). The vibrator also can include a counter-flow air brake to slow rotor rotation.

11 Claims, 2 Drawing Sheets

COMPRESSED AIR VIBRATOR WITH TURBINE DRIVE

FIELD OF THE INVENTION

The present invention relates to a turbine drive compressed air vibrator using an unbalanced cylindrical rotor, two ball bearing assemblies for seating the rotor, a substantially closed housing with a cylindrical chamber in which the rotor is rotatably disposed, an inlet opening at the housing for admitting compressed air to the chamber and an outlet opening for the exit of air from the chamber.

BACKGROUND OF THE INVENTION

A compressed air vibrator of this species is known from U.S. Pat. Nos. 3,932,057 and 3,870,282. The compressed air vibrators of these references use ball bearings that are disposed in the interior of the rotor. Therefore, the bearings are limited as to their size, which, at high frequencies and with strong resonant oscillations, has a disadvantageous effect on the service life of the vibrator and, in particular, on the bearings themselves. In connection with the mentioned vibrators it is also considered to be disadvantageous that the bearings are too weak with respect to their loads. Replacement of the bearings can only be performed by specialists and is a comparatively expensive procedure.

OBJECT AND SUMMARY OF THE INVENTION

It is, therefore, the object of the present invention to provide a compressed air vibrator, of the mentioned species, which has a considerably longer service life and which can also be maintained and repaired considerably more easily.

This object is attained in that the ball bearing assemblies are disposed on shafts of the rotor and are fitted into bores of oppositely located covers that are, in turn, removably secured to the vibrator housing.

Thus, in the compressed air vibrator in accordance with the invention, use of ball bearing assemblies disposed between the shafts of the rotor and the bores of the covers allows use of larger ball bearing assemblies than those previously used. This results in increased service life for the bearings, and grease can be packed about the bearings. Accordingly, the bearing assemblies are considerably stronger and can accommodate greater loads.

When changing a defective bearing of the compressed air vibrator of the present invention, it is sufficient to simply remove one of the two covers, for example with a socket wrench. Then, because the ball bearing assemblies are relatively loosely inserted into the bore of the covers, with a slight amount of play, the two ball bearing assemblies and the rotor can be manually removed from the rotor housing and the defective ball bearings can then be replaced by new ones. Assembly is also simple and takes place in the reverse sequence. Thus, the piece to be repaired needs to be stopped only for a short time during repairs.

In accordance with a further embodiment of the invention, the covers are fastened on the housing with a left-hand thread and a right-hand thread in such a way that the covers are tightened against the housing by means of the relative movement between the outer races of the ball bearing assemblies and the bores of the covers during rotation of the rotor. This has the result that the covers can never be undone because of resonant oscillations. This increases safety and the integrity of the system.

The ease of repair of the vibrator in accordance with the invention is further improved if the ball bearing assemblies are disposed on the shafts of the rotors with a slight amount of play or looseners.

Service life is increased if, in accordance with a further embodiment of the invention, the shafts of the rotor and the covers in the bores are strongly anodized or otherwise protected against wear.

The compressed air vibrator of the present invention permits gentle and dependable reduction of the rundown time, because of which increased service life, along with simple repair and maintenance, can also be achieved.

Other objects, features, and characteristics of the present invention will become apparent upon consideration of the following description in the appended claims with reference to the accompanying drawings, all of which form a part of the specification, and wherein the same reference numerals designate corresponding parts in the various figures.

DETAILED DESCRIPTION OF THE PREFERRED EMBODIMENTS

Figure 1:
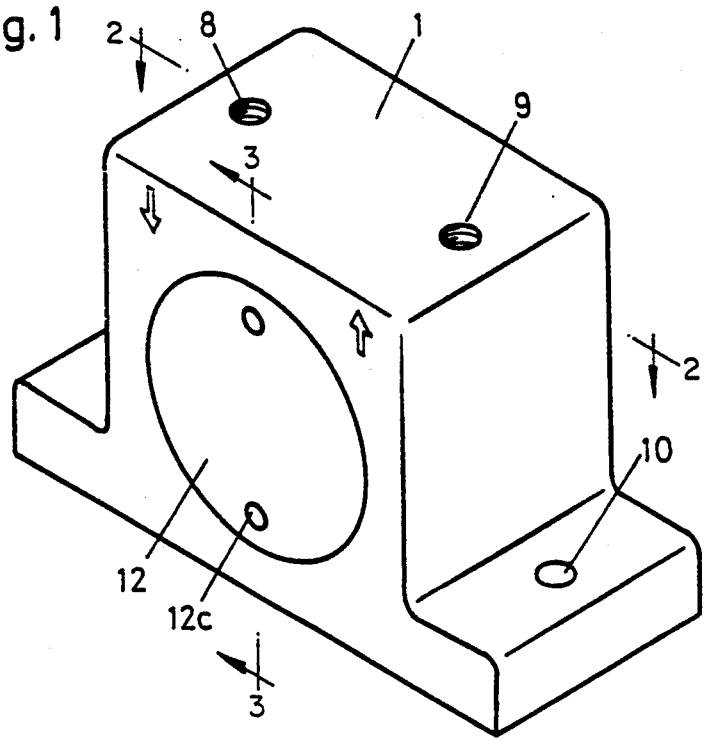
FIG. 1 is a perspective view of a compressed air vibrator in accordance with the invention.
Figure 2:
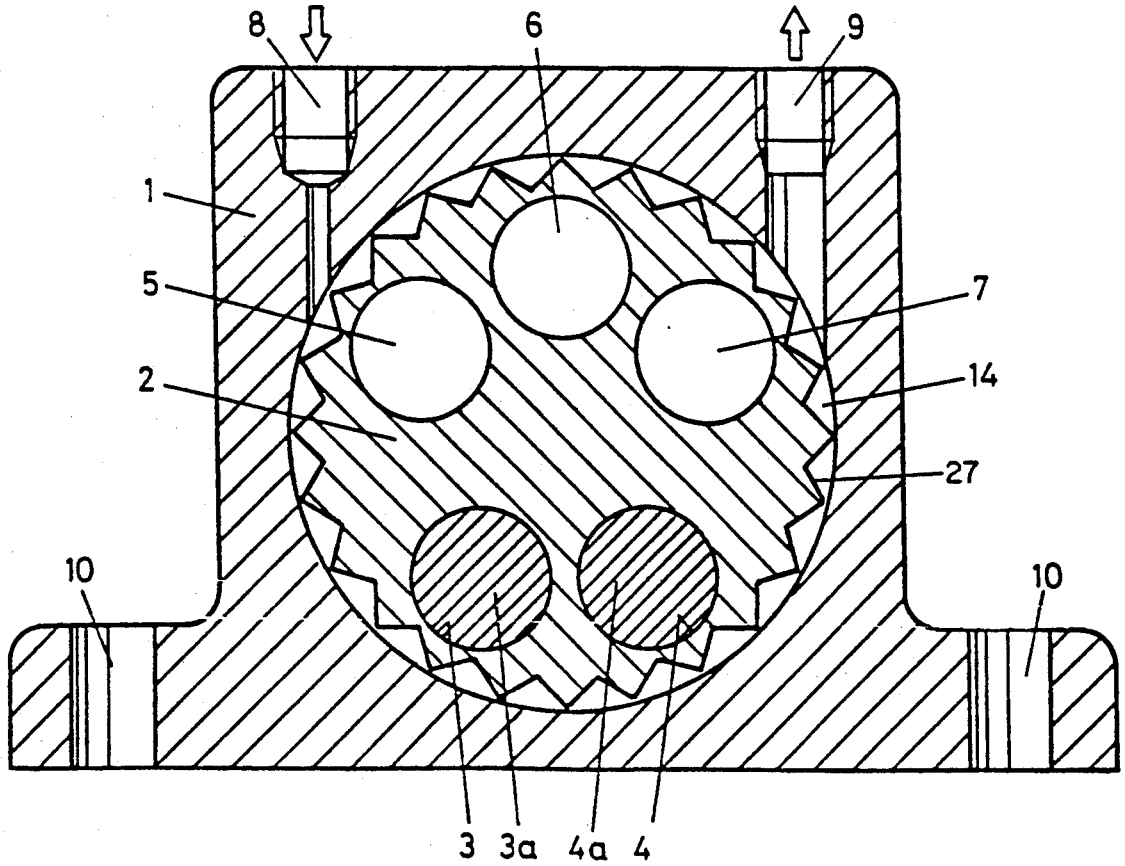
FIG. 2 is a vertical section through the vibrator shown in FIG. 1, taken along lines 2—2.
Figure 3:
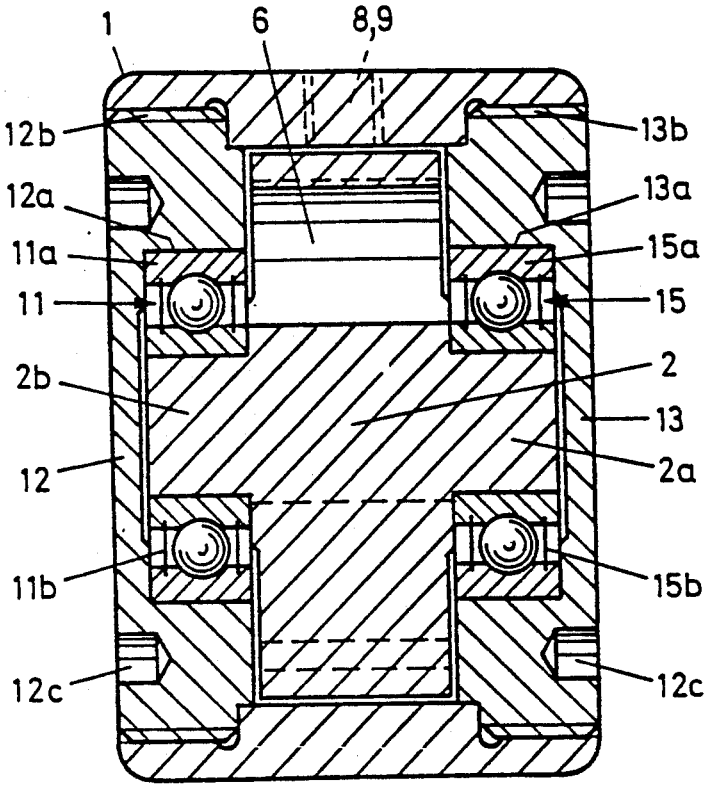
FIG. 3 is a vertical section taken along lines 3—3 in FIG. 1.

With reference initially to FIGS. 1 to 3, the compressed air vibrator is comprised of a housing 1, which has an inlet opening 8 for admitting compressed air into a chamber 14 and an outlet opening 9 for the exit of air from chamber 14. A rotor 2 having shafts 2*a* and 2*b*, on which ball bearing assemblies 11 and 15, respectively, are seated relatively loosely or with slight play, is inserted into and rotates within chamber 14. The outer races 11*a* and 15*a* of the two ball bearing assemblies are designed to fit in bores 12*a* and 13*a* of oppositely located covers 12 and 13 with a slight amount of play. Each of the covers 12 and 13 is suitably fastened to the housing 1 by an approach that on turning will tighten the cover/housing connection, such as, for example, by means of mating threads 12*b* or 13*b* between the housing and the exterior periphery of covers 12 and 13. One of these threads, either 12*b* or 13*b*, is a left-hand thread while the other thread, 12*b* or 13*b*, is a right-hand thread. Because of this, the covers 12 and 13 will be tightened against the housing 1 by rotation of the rotor 2. Recesses 12*c* are provided in the exterior of the covers 12 and 13, through which the covers can be loosened by means of an appropriate socket wrench. It should be noted that preferably shafts 2*a* and 2*b*, as well as the bores 12*a* and 13*c* of covers 12 and 13, respectively, are anodized or otherwise treated to protect them.

The ball bearing assemblies 11 and 12 are sealed and for this purpose have conventional seals 11*b* and 15*b*, as illustrated in FIG. 3.

The rotor 2 is preferably made of aluminum although other materials could be employed. Rotor 2 has five axial bores 3 to 7 extending therethrough. The bores 5, 6 and 7 are blank bores and, as shown, are not filled. Bores 3 and 4, however, are filled with inserts 3*a* and 4*a*, respectively. These inserts 3*a* and 4*a* are comprised of a metal heavier than aluminum, for example steel, brass or lead. By means of the inserts 3*a* and 4*a* the rotor 2 is given a positive unbalanced mass, while the blank bores 5, 6 and 7, constituting negative unbalanced mass, increase the total unbalanced mass of the rotor 2. However, it is also possible, for example, to equip only bore 6 with a suitable insert, the other bores remaining empty, thereby allowing the creation of a decreased unbalanced mass and thus higher frequencies with the same components.

Figure 4:
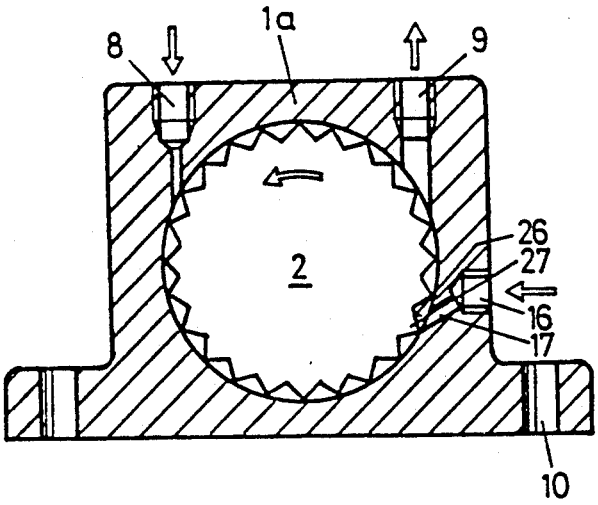
FIG. 4 is a vertical section through a second embodiment of the compressed air vibrator in accordance with the invention.
Figure 5:
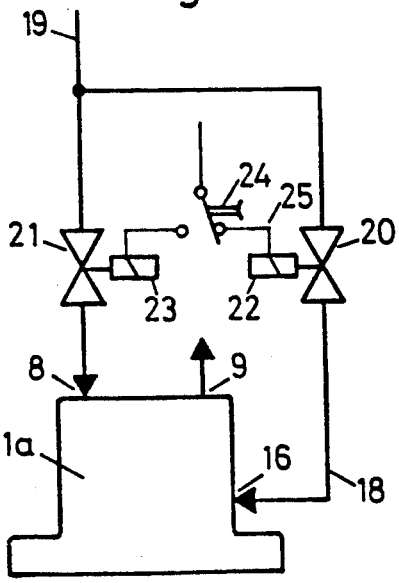
FIG. 5 is a schematic view of the vibrator in accordance with FIG. 4 as well as the lines and control means connected therewith.

The compressed air vibrator illustrated in FIGS. 4 and 5 differs from the above mentioned vibrator in that a brake in the form of a fluid, such as air, can be injected against the rotor 2 in counter-current flow opposite the rotation direction of rotor 2. Such flow can occur through a nozzle 17 with a suitable connector 16 for a pneumatic brake line is disposed in the housing 1*a* directly in front of the outlet opening 9. As can be seen, the outlet end of nozzle 17 is directed against the backs 26 of the teeth 27 of the rotor 2. The cross section of the passage in the brake nozzle 17 is a little larger than the cross section of the inlet nozzle 8.

As shown in FIG. 5, the brake line 18 is connected via a valve 20 to one branch of a supply line 19, in which an air pressure of 6 bar, for example, is present. The valve 20 is operated by means of a time delay relay device 22 (such as, for example, a fall delay timer), which is connected via an electric control line 25 with a switch 24. Another valve 21 is also disposed in another branch of supply line 19, the operation of which is controlled by relay 23, which is also connectable with and actuated by the switch 24 via electric line 30.

In operation, to brake the rotor 2, switch 24 activates time delay relay 22 thereby opening valve 20 for a selected limited time. This allows, at the moment of switching, a burst of air of defined length to be directed against and opposite to the direction of rotation of the rotor 2. This braking does not cause wear of rotor 2. A braking time of less than one second is achieved although the limited open time for value 20 can vary from about 3 sec. to about 0.1 sec. In this way it is possible to trigger the vibrator of the invention at intervals, which is of particular advantage for packaging powdery or granulated materials.

While the invention has bee described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A compressed air, turbine drive, vibrator comprised of an outer housing having an internal cylindrical chamber terminating at two open ends, each open end being closed by a cover removably secured to said outer housing, said housing further including an inlet opening for admitting compressed air to internal chamber and an outlet opening for allowing the exit of air from the internal chamber, an unbalanced cylindrical rotor provided with a support shaft extending axially outwardly from opposite sides of the rotor, each support shaft being rotatably mounted within a ball bearing assembly, each said cover including an interior bore for receiving therein an outer race of one of said ball bearing assemblies in a manner that permits relative rotation between said outer race and said cover during rotation of the rotor.

2. A compressed air vibrator as in claim 1 wherein the relative rotation between said outer race and said cove tightens the cover to the housing.

3. A compressed air vibrator as in claim 2 wherein said covers are threadedly secured to said housing.

4. A compressed air vibrator as in claim 3 wherein one cover is secured by left-hand threads and the other by right-hand threads.

5. A compressed air vibrator as in claim 1 wherein the ball bearing assemblies are loosely disposed on said support shafts.

6. A compressed air vibrator as in claim 1 wherein said support shafts and the bores of said covers are anodized.

7. A compressed air vibrator as in claim 1, wherein said rotor is provided with a plurality of axially extending bores, a first group of less than all of said plurality of bores being provided with an insert material to unbalance said rotor.

8. A compressed air vibrator as in claim 7 wherein said insert material has a specific weight greater than that of said rotor.

9. A compressed air vibrator as in claim 7 wherein the first group of bores are filled with said insert material.

10. A compressed air vibrator as in claim 7 wherein said insert material is a heavy metal.

11. A compressed air vibrator as in claim 10 wherein said heavy metal is brass or lead.

* * * * *